United States Patent [19]

Yuhara et al.

[11] Patent Number: 4,683,899

[45] Date of Patent: Aug. 4, 1987

[54] VANITY CASE

[75] Inventors: Yukitomo Yuhara, Abiko; Yuji Shioi, Tokyo, both of Japan

[73] Assignee: Yoshida Industry Co., Ltd., Tokyo, Japan

[21] Appl. No.: 755,348

[22] Filed: Jul. 16, 1985

[30] Foreign Application Priority Data

| | | | |
|---|---|---|---|
| Apr. 3, 1985 | [JP] | Japan | 60-48690 |
| Apr. 4, 1985 | [JP] | Japan | 60-49223 |
| Apr. 5, 1985 | [JP] | Japan | 60-49988 |

[51] Int. Cl.[4] ..... A45D 33/00

[52] U.S. Cl. ..... 132/82 R; 132/83 R

[58] Field of Search ..... 132/79 R, 79 F, 79 G, 132/82 R, 83 R, 83 D; 292/DIG. 37, 83, 85, 86

[56] References Cited

U.S. PATENT DOCUMENTS

| | | | |
|---|---|---|---|
| 1,794,339 | 2/1931 | Noble | 132/83 R |
| 2,035,831 | 3/1936 | Parkin | 132/83 R |
| 2,734,517 | 2/1956 | Ferraro | 132/83 R |
| 4,276,893 | 7/1981 | Enomoto et al. | 132/83 R |
| 4,366,829 | 1/1983 | Yuhara | 132/83 R |
| 4,387,730 | 6/1983 | Shioi | 132/83 R |
| 4,392,503 | 7/1983 | Watanabe | 132/83 R |
| 4,399,826 | 8/1983 | Ogasawara | 132/83 R |

FOREIGN PATENT DOCUMENTS

| | | | |
|---|---|---|---|
| 2338671 | 8/1977 | France | 132/83 R |
| 2471326 | 6/1981 | France | 132/79 R |
| 2534747 | 4/1984 | France | 132/83 R |

*Primary Examiner*—Robert Peshock
*Assistant Examiner*—Cary E. Stone
*Attorney, Agent, or Firm*—Wenderoth, Lind & Ponack

[57] ABSTRACT

A vanity case includes receptacle and cover hinged with each other at the rear ends thereof, the cover being maintained in a closed position by engagement between latch tongues formed on the receptacle and the cover. The receptacle is formed at the front end with a recess within which is slidably disposed a push piece having a front wall and an arm integrally formed with the front wall through a thin flexible section which permits the arm to tilt relative to the front wall. The rear end of the arm is positioned closely adjacent the lower surface of the cover. A projection is provided to extend from the bottom surface of the recess and is positioned away from the inner wall of the recess. The lower surface of the arm is in contact with the projection and, upon rearward movement of the push piece, slides on the projection to tilt the arm whereby the rear end of the arm forces the cover in upward and forward directions to release the engagement of the latch tongues.

11 Claims, 12 Drawing Figures

VANITY CASE

BACKGROUND OF THE INVENTION

The present invention relates to a vanity case for use with make-up or the like. More particularly, this invention relates to an improvement of a vanity case of a type in which a receptacle member and a cover member are hinged together at the rear ends thereof and are arranged to be latched by snap engagement between a first latch tongue of the cover and a second latch tongue formed on an inner wall defining a recess which is formed in the front end of the receptacle to receive a push piece. The push piece is movable in the recess and is adapted to, upon rearward movement thereof, produce a force which urges the cover upwardly so as to release the engagement of the latch tongues.

A vanity case of the type set forth above is disclosed in, for example, U.S. Pat. No. 4,276,893 wherein the push piece is molded of relatively hard plastic material and includes an inner end portion and an enlarged outer end portion to form an inclined surface therebetween, the surface being inclined upwardly toward the outer end and abutting a lower end of a nose having the first latch tongue and extending from the lower surface of the cover when the latter is in a closed position with respect to the receptacle. Thus, pressing the push piece inwardly causes the nose to slide on the inclined surface, thereby urging the nose upwardly to open the cover.

In the above vanity case, however, the force acting on the nose has a direction perpendicular to the inclined surface and therefore includes a component of force in a horizontal direction, which component tends to urge the nose toward the inner wall of the recess where the second latch tongue is formed. It thus will be understood that a user would have to press the push piece with a relatively large force in order to open the cover since the component in horizontal direction tends to strengthen the engagement between the first and second latch tongues. This is not desirable in view of the nature of the vanity case.

Further, the usual size of the vanity case does not allow the inclined surface to be elongated to the extent that the push piece can lift the front end of the cover sufficiently for assuring smoothness of subsequent operation. Steep inclination would improve the situation but only with an increased force to be required for pressing the push piece.

SUMMARY OF THE INVENTION

It is therefore an object of the present invention to provide a vanity case of the type set forth above in which a push piece, upon rearward movement thereof, exerts on a cover member such a force as to urge the cover member both in upward and forward directions, thereby releasing engagement between a first latch tongue and a second latch tongue with a relatively small force compared with the known arrangements.

Another object of the present invention is to provide a vanity case in which a front end of a cover can be lifted considerably by a push piece.

A still further object of the present invention is to provide a vanity case including a push piece which may be a one-piece mold to thereby permit the vanity case to be manufactured and assembled easily.

A further object of the present invention is the provision of a vanity case in which a push piece, upon removal of pressure applied thereto, may automatically return to its normal position and be held thereat whereby the push piece is prevented from clattering within a recess after a cover member is opened with respect to a receptacle member.

According to the present invention, a vanity case comprises a receptacle member molded of plastic material for containing cosmetic material, a cover member also molded of plastic material and hinged with the receptacle member at rear ends thereof, a recess formed in the front end of the receptacle member and defined by an inner wall, a bottom surface and side walls, a first latch tongue formed on the cover member, and a second latch tongue formed on the inner wall of the recess, the first and second latch tongues being engaged with each other by snap action when the receptacle member is closed by the cover member to thereby maintain the cover member in a closed position with respect to the receptacle member. Disposed within the recess is a push piece which is movable therein backward and forward and which has a front wall and an arm integrally formed with the front wall through a thin flexible section, the arm being inclined upwardly toward the rear end thereof and the flexible section permitting the arm to tilt with respect to the front wall. The rear end of the arm is positioned closely adjacent the lower surface of the cover member in the closed position of the cover member. A projection extends upwardly from the bottom surface of the recess and is positioned away from the front wall of the push piece, the lower surface of the arm being in contact with the projection and, upon rearward movement of the push piece, sliding on the projection to tilt the arm whereby the rear end of the arm forces the lower surface of the cover member in upward and forward directions to release engagement between the latch tongues.

The projection may be integrally formed with the bottom surface of the recess at a position away from the inner wall.

Alternatively, the projection may be formed as a part of the push piece and movable with respect to the front wall while being prevented from moving rearwardly by a stopper means. The stopper means preferably comprises the inner wall of the recess, the rear surface of the projection abutting against the inner wall.

In one embodiment of the present invention, the push piece includes a pair of elastic strips connecting the projection to the front wall. Each strip is, upon rearward movement of the push piece, bent to thereby permit the front wall to approach the projection.

In another embodiment of the invention the push piece includes a rigid bar connecting the projection to the front wall and having a flexible portion which permits the bar to swing between a first position where the projection rests against the stopper means and a second position where the projection is moved toward the front wall.

In any of the embodiments of the invention, it is preferable that the lower surface of the cover member includes a nose on which the first latch tongue is formed, the upper end of the nose in the closed adjacent the lower end of the nose in the closed position of the cover member.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
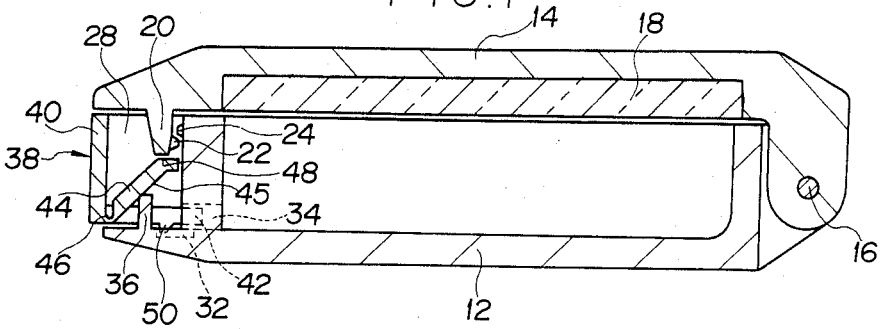
FIG. 1 is a longitudinally sectional view showing a vanity case according to a first embodiment of the present invention.

Referring to FIGS. 1 to 4 of the drawings, there is illustrated a vanity case according to a first embodiment of the invention. The vanity case generally designated by numeral 10 includes a receptacle member 12 adapted to receive therein a cosmetic material or the like and molded of plastic material, and a cover member 14 also molded of plastic material and hinged with the receptacle 12 at respective rear ends through a pin 16. Attached to the inner surface of the cover 14 is a mirror 18 for convenience in make-up. A projection or nose 20 extends downwardly from the front end of the cover 14 and is provided with a first latch tongue 22 which projects rearward to engage with a second latch tongue 24 formed on an inner wall 26 of the receptacle 12. The inner wall 26 defines a box-like recess 28 formed in the central portion of the front end of receptacle 12 for permitting the nose 20 to enter therein. The cover 14 is maintained in a closed position with respect to the receptacle 12 by snap engagement between the first and second latch tongues 22 and 24.

The recess 28 is also defined by a bottom surface 30 in which is formed a groove 32 positioned at substantially equal distance from each side wall that also defines the recess. The lower end of the inner wall 26 is excavated at positions corresponding to the groove 32 to provide a guide hole 34. A pair of projections 36 of rectangular shape extend upwardly from the bottom surface 30 at positions sufficiently away from the inner wall 26 toward the front opening of the recess 28, the projections 36 being adjacent to the respective side walls so as to provide a central space therebetween. Positioning and height of the projections 36 may be determined by various factors such as desirable angle to be obtained, and desirable force to be required, for a push piece as described hereinafter.

Figure 2:
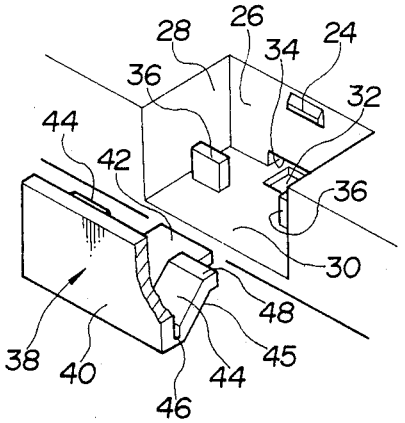
FIG. 2 is a fragmentary perspective view, partly broken, illustrating a recess and a push piece of the vanity case in FIG. 1.

Disposed within the recess 28 is a push piece 38 adapted to function as a releasing member for the latch tongues 22 and 24. The push piece 38 is a one-piece mold of plastic material and, as best shown in FIG. 2, comprises a vertical front wall 40, a guide plate 42 extending rearwardly from the lower end of the wall 40 at a central portion thereof, and a pair of tilt arms 44 which are spaced from each other by a distance larger than the width of the guide plate 42 and which are integrally connected to the lower end of the wall 40 by means of flexible sections 46. Each flexible section 46 is formed so thin that it permits the arm 44 to be tilted relative to a plane perpendicular to the wall 40. From the tip end of the section 46 the tilt arm 44 obliquely extends upwardly toward its outer or rear end which is inclined relative to the longitudinal axis of the arm 44 to form a flat upper end surface 48. A pawl 50 is provided on the lower surface of the guide plate 42 to slidably engage with the groove 32 of the receptacle 12.

Figure 3:
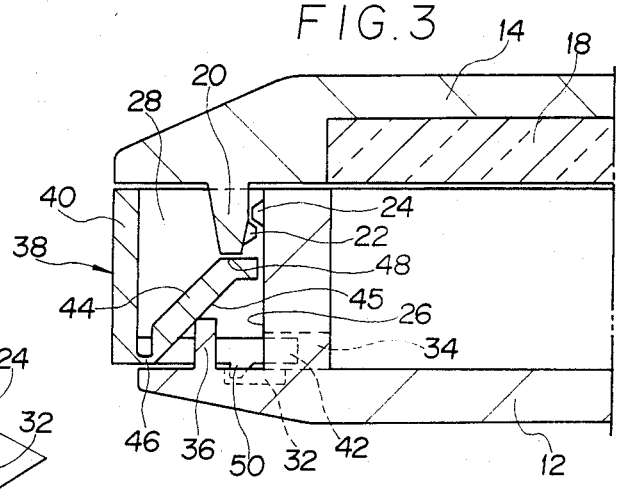
FIG. 3 is an enlarged sectional view of the vanity case in FIG. 1, with the push piece being in a normal position.

In order to mount the push piece 38 in the recess 28, the guide plate 42 is forcedly inserted into the hole 34 while engaging the pawl 50 with the groove 32. The push piece 36 thus mounted in the recess 28 is movable therein toward and away from the inner wall 26 and is retained therein by the engagement of the pawl 50 with the groove 32. Once the push piece 38 is mounted in the recess 28, the slant lower surfaces 45 of the tilt arms 44 come into contact with and rest against the upper front edge of the respective projections 36 and the upper end surfaces 48 of arms 44 are closely adjacent to the lower end of the nose 20 when the cover 14 is in the closed position, as shown in FIGS. 1 and 3. If desired, the nose 30 may be so designed as to directly abut against the surfaces 48.

Figure 4:
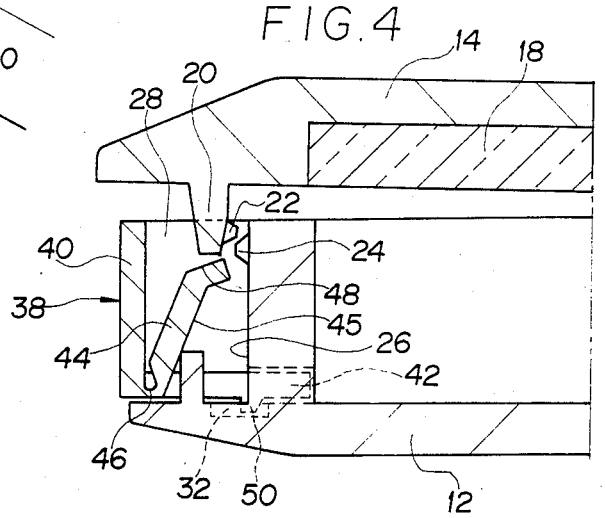
FIG. 4 is also an enlarged sectional view of the vanity case showing the push piece in an active position.
Figure 5:
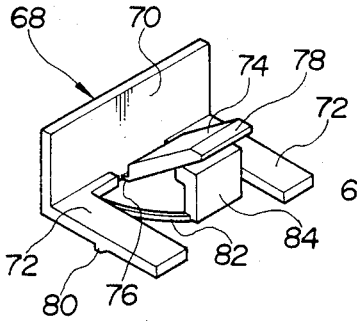
FIG. 5 is a perspective view of a push piece according to a second embodiment of the present invention.

Assuming now that the cover 14 is closed over the receptacle 12 as shown in FIG. 3, when the front wall 40 is forced to move the push piece 38 rearwardly, the slant lower surfaces, 45 of the arms 44 slide on the projections 36 so that the arms 44 are further tilted while bending or warping the flexible sections 46. This increased tilt of the arms 44 causes the upper end surfaces 48 to press the nose 20 upward and forward, whereby the second latch tongue 24 is disengaged from the first latch tongue 22 and the cover 14 is opened with respect to the receptacle 12, as shown in FIG. 4. Thereafter, upon removal of the pressure applied to the wall 40, the push piece 38 is returned to the normal position of FIG. 3 by the flexibility of elasticity of the sections 46, preventing the push piece from clattering in the recess 28.

It is to be noted here that the disengagement of the first latch tongue 22 from the second latch tongue 24 can be achieved with relatively small force because the tilt arms 44 press the nose 20 not only in the upward direction but also in the forward direction so that engagement between the latch tongues is weakened. The push piece 38 is a one-piece mold as mentioned above and may be formed by injection molding by using a simple die to reduce manufacturing costs. Also, assembly can be carried out easily by mounting the single piece 38 in the recess 28. Further, the projections 36 are formed at a position sufficiently away from the inner wall 26 toward the front opening of the recess 28 where the front wall 40 of push piece 38 is situated. This location of the projections 36 enhances the tilting of the arms 44, whereby the front end of the cover 14 can be considerably lifted to permit a user to insert her finger into the space between the cover 14 and the push piece 38 for opening the cover 14 to a desired angle.

In the above embodiment the arms 44, upon inward or rearward movement of the push piece 38, acts on the nose 20 of the cover 14. It is possible within the scope of the present invention to have the tilt arms act on other portions of the lower surface of the cover 14. The lower surfaces of the tilt arms 44 are not necessarily inclined if the projections 36 in the recess 28 include surface portions inclined in the same direction as that of the surfaces 45. Also, both the tilt arms 44 and the projections 36 may include slanted surfaces for contact with each other.

A second embodiment of the present invention will be described with reference to FIG. 5 to 8 wherein the same reference numerals will be used to indicate the same parts as in the first embodiment. A push piece 68 according to this embodiment includes a pair of guide plates 72 extending rearwardly from a lower end of a front vertical wall 70 at opposite sides thereof, and a tilt arm 74 formed between the guide plates and integrally connected to the lower end of the wall 70 through a flexible section 76. A pair of elastic strips 82 are formed to extend from the inner sides of the respective guide plates 72 at positions near the front wall 70. These strips 82 extend rearwardly and away from the guide plates 72 with a slight curvature and terminate at respective sides of a projection 84 which is located between the guides plates 72. The projection 84 preferably has an inverted L-shape including an upper flange the front edge of which is in contact with a slanted lower surface 75 of the arm 74 to maintain the latter in the titled state. The strips 82 are so flexible that they can bend to permit a displacement of the projection 84 with respect to the wall 70 as will be described later. The push piece 68 including the strips 82 and projection 84 is preferably a one-piece mold of plastic material and may be formed by an injection molding operation.

Figure 6:
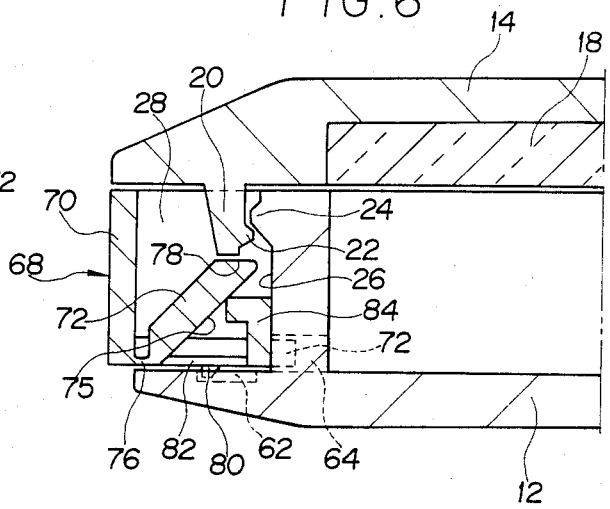
FIG. 6 is a fragmentary sectional view of a vanity case incorporating the push piece of FIG. 5.
Figure 8:
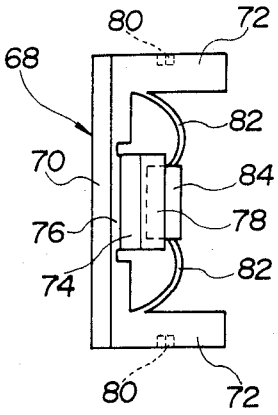
FIG. 8 is a plan view of the push piece in the active position of FIG. 7.

Each guide plate 72 has at its lower surface a pawl 80 which is slidably engageable with a groove 62 formed at a corresponding position on the bottom surface 30 of the recess 28. The lower end of the inner wall 26 defining the recess 28 is excavated to provide a pair of guide holes 64 into which the guide plates 72 are inserted for mounting the push piece 68 in the recess 28. When the push piece 68 is thus mounted and retained in the recess 28, the rear surface of the projection 84 abuts against the inner wall 26 and the upper end surface 78 of arm 74 is closely adjacent to the lower end of the nose 20, as shown in FIG. 6.

Figure 7:
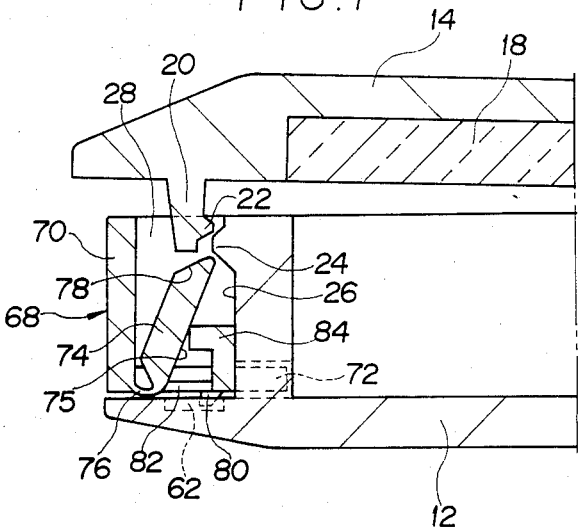
FIG. 7 is a view similar to FIG. 6 with the push piece in an active position.

Pressure applied to the front wall 70 causes the push piece 68 to move rearwardly except for the projection 84, rearward movement of which is prevented by the inner wall 26. Accordingly, as the front wall 70 approaches the projection 84, the arm 74 slides on the edge of projection 84 to increase its tilt toward the wall 70 while upper surface 78 presses the nose 20 upwardly and forwardly, whereby the engagement between latch tongues 22 and 24 is released and the cover 14 is opened as shown in FIG. 7. The strips 82 are bent into an arcuate shape illustrated in FIG. 8 in order to permit the wall 70 to approach the projection 84 and, after the pressure on the wall 70 is removed, return the push piece 68 to its normal position in cooperation with the flexible section 76.

Figure 9:
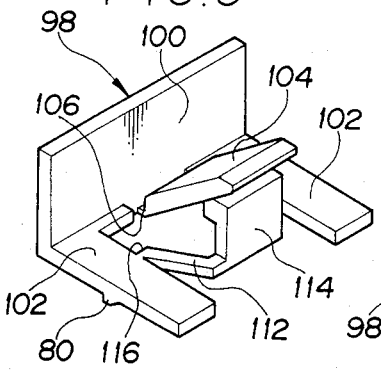
FIG. 9 is a perspective view illustrating a push piece according to a third embodiment of the present invention.
Figure 10:
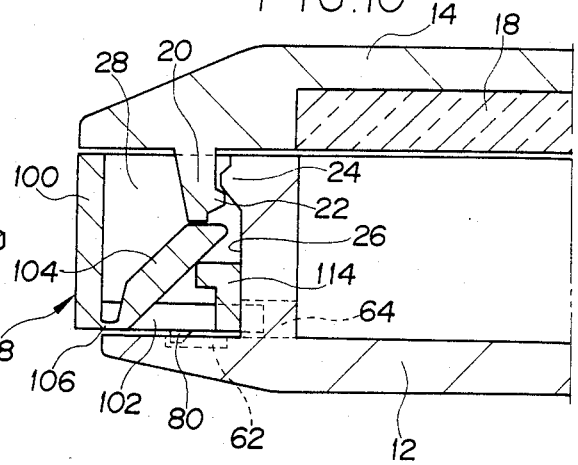
FIGS. 10 and 11 are views similar to FIGS. 6 and 7, respectively, with the push piece of FIG. 9.

A push piece 98 illustrated in FIG. 9 is similar to the push piece 68 of the second embodiment but includes a single rigid bar 112 connecting a projection 114 to one of guide plates 102. The bar 112 is illustrated to have an angular shape and extends from the inner side of one guide plate 102 rearwardly and away from the guide plate, terminating at the side of projection 114. A thin, flexible portion is formed as at 116 so as to permit the rigid bar 112 to swing around the portion 116. Once the push piece 98 is mounted in the recess 28 in the same manner in the second embodiment, the rear surfaces of the projection 114 and of a part of the angular bar 112 are contiguous to the inner wall 26 as noted from FIG. 10.

Figure 11:
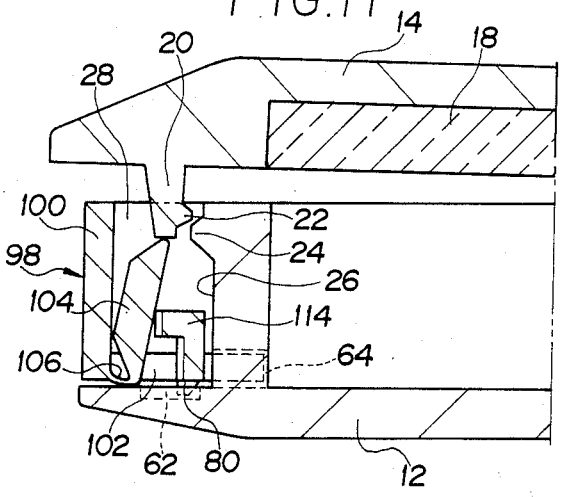
Figure 12:
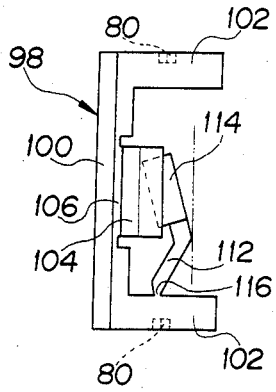
FIG. 12 is a plan view showing an active position of the push piece of FIG. 9.

When a pressure is applied to the front wall 100 to move the push piece 98 rearwardly, an arm 104 slides on the edge of projection 114 to increase its tilting. At the same time, since the rearward movement of rigid bar 112 is restrained by the inner wall 26 which is indicated by the dash and dotted line in FIG. 12, the bar 112 swings with its angular edge being in continuous contact with the wall 26, as the flexible portion 116 moves rearwardly. This swinging of the bar 112 shifts the projection 114 toward the front wall 100 while inclining the projection with respect to the wall 26. Consequently, the arm 104 is further tilted due to the reduced distance between the front edge of the projection 114 and the flexible section 106 as shown in FIG. 11, whereby the cover 14 is opened.

In the embodiments of FIGS. 5 through 12 the projections 68 and 98 abut against the inner wall 26 of the recess 28. If desired, however, a suitable stopper means is provided which may extend from the bottom surface 30 and support the rear surface of projection to prevent the rearward movement thereof. Also, the projections 68 and 98 may include a slanted surface portion instead of or together with the slanted lower surface of the arm, as described in connection with the first embodiment.

Although the present invention has been described with reference to the preferred embodiments thereof, many modifications and alterations may be made within the spirit of the invention.

What is claimed is:

1. A vanity case comprising:

a receptacle member molded of plastic material for containing cosmetic material;

a cover member molded of plastic material;

said receptacle and cover members being hinged together at respective rear ends thereof;

a recess formed in a front end of said receptacle member and defined by an inner wall, a bottom surface and side walls;

a first latch tongue formed on said cover member;

a second latch tongue formed on said inner wall of said recess;

said first and second latch tongues being engaged with each other by snap action when said receptacle member is closed by said cover member, thereby maintaining said cover member in a closed position with respect to said receptacle member;

a push piece disposed within said recess and being movable therein rearwardly and forwardly, said push piece having a front wall and an arm integrally formed with said front wall through a thin flexible section, said arm being inclined upwardly toward a rear end thereof, said flexible section permitting said arm to tilt with respect to said front wall, said rear end of said arm being positioned closely adjacent a lower surface of said cover member in said closed position of said cover member; and a projection extending upwardly from said bottom surface of said recess and positioned spaced from said front wall of said push piece, a lower surface of said arm being in contact with said projection and, upon rearward movement of said push piece, sliding on said projection to tilt said arm whereby said rear end of said arm forces said lower surface of said cover member in upward and forward directions to release engagement between said first and second latch tongues.

2. A vanity case as claimed in claim 1, wherein said projection is integrally formed with said bottom surface of said recess at a position spaced from said inner wall.

3. A vanity case as claimed in claim 1, wherein said projection is formed as a part of said push piece and is movable with respect to said front wall, said projection being prevented from moving rearwardly by a stopper means.

4. A vanity case as claimed in claim 3, wherein said stopper means comprises said inner wall of said recess, a rear surface of said projection abutting against said inner wall.

5. A vanity case as claimed in claim 4, wherein said projection has an inverted L-shape including an upper flange extending toward said front wall.

6. A vanity case as claimed in claim 3, wherein said push piece includes a pair of elastic strips connecting said projection to said front wall, each of said strip being bent upon rearward movement of said push piece thereby to permit said front wall to approach said projection.

7. A vanity case as claimed in claim 6, wherein said push piece further comprises a pair of spaced guide plates formed integrally with said front wall and extending rearwardly from a lower end of said front wall, each said strip extending between said projection and an inner side of a respective said guide plate.

8. A vanity case as claimed in claim 3, wherein said push piece includes a rigid bar connecting said projection to said front wall and having a flexible portion, said flexible portion permitting said bar to swing between a first position where said projection rests against said stopper means and a second position where said projection is moved toward said front wall.

9. A vanity case as claimed in claim 8, wherein said push piece further includes a guide plate formed integrally with said front wall and extending rearwardly from a lower end of said front wall, said bar extends from an inner surface of said guide plate to said projection and said flexible portion of said bar is formed at junction to said guide plate.

10. A vanity case as claimed in claim 1, wherein said rear end of said arm includes a surface so inclined relative to the longitudinal axis of said arm as to extend parallel to said lower surface of said cover member.

11. A vanity case as claimed in claim 1, wherein said lower surface of said cover member includes a nose on which said first latch tongue is formed, said rear end of said arm being closely adjacent a lower end of said nose in said closed position of said cover member.

* * * * *